US008699905B2

(12) United States Patent
Collison et al.

(10) Patent No.: US 8,699,905 B2
(45) Date of Patent: Apr. 15, 2014

(54) TONER COVERAGE DETERMINATION

(75) Inventors: Sean Michael Collison, Meridian, ID (US); Brandi Michelle Pitta, Eagle, ID (US); Michael Joseph Martin, Boise, ID (US); George Henry Kerby, Boise, ID (US)

(73) Assignee: Hewlett-Packard Development Company, LP., Houston, TX (US)

( * ) Notice: Subject to any disclaimer, the term of this patent is extended or adjusted under 35 U.S.C. 154(b) by 191 days.

(21) Appl. No.: 13/491,187

(22) Filed: Jun. 7, 2012

(65) Prior Publication Data

US 2013/0330097 A1 Dec. 12, 2013

(51) Int. Cl.
*G03G 15/20* (2006.01)

(52) U.S. Cl.
USPC ..... 399/69

(58) Field of Classification Search
CPC ..... G03G 15/20
USPC ..... 399/60, 39, 69
See application file for complete search history.

(56) References Cited

U.S. PATENT DOCUMENTS 6,895,193 B2 * 5/2005 Takamatsu et al.
7,817,290 B2 10/2010 Klassen et al.
2010/0111547 A1 * 5/2010 Kawamoto et al.

FOREIGN PATENT DOCUMENTS

JP 10138555 A * 5/1998

OTHER PUBLICATIONS

Beets, Kristof, et al., Super-sampling Anti-aliasing Analyzed, Beyond3D, Apr. 28, 2000.

* cited by examiner

*Primary Examiner* — Susan Lee

(57) ABSTRACT

A toner coverage determination system and method are described. The toner coverage determination system may include a memory storing a module comprising machine readable instructions to receive an input image, and generate a grid including a plurality of points corresponding to pixels to be sampled on the input image. The machine readable instructions may further sample the pixels corresponding to the plurality of points, evaluate pixel intensity values for the sampled pixels, and determine a toner coverage value based on the evaluated pixel intensity values.

16 Claims, 9 Drawing Sheets

TONER COVERAGE DETERMINATION

BACKGROUND

A fuser assembly in a printer can be used to heat and pressure bond toner onto media passing through the fuser assembly. Examples of factors that can affect adequate fixing of toner onto media include the relative speed of media going through the fuser assembly, fuser temperature and toner density needed on the media. For example, lower fuser temperatures are typically used for slower printing speeds, and conversely, relatively higher fuser temperatures are typically used for faster printing speeds. The fuser temperature and printing speed can be determined based on the contact time needed for a fuser to melt the toner that is then bonded onto the media. Generally, higher fuser temperatures result in increased emission of volatile organic compounds (VOCs). In order to reduce VOCs, the fuser temperature can be reduced, which however results in reduced print speed, which is needed to properly fuse toner to the media. These factors can impact a printer's throughput.

BRIEF DESCRIPTION OF DRAWINGS

Features of the present disclosure are illustrated by way of example and not limited in the following figure(s), in which like numerals indicate like elements, in which.

DETAILED DESCRIPTION

Figure 1:
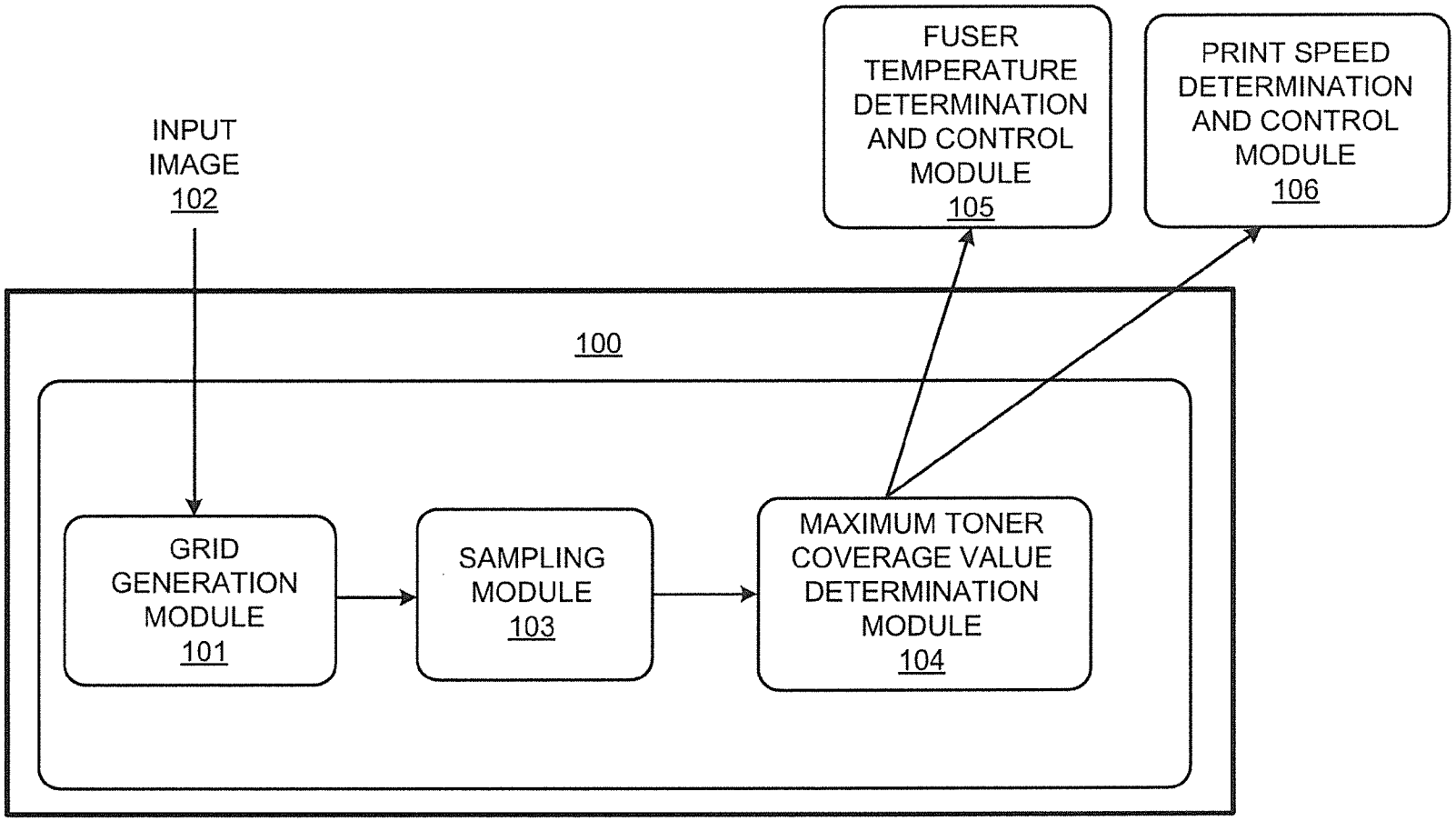
FIG. 1 illustrates an architecture of a toner coverage determination system, according to an example of the present disclosure.

For simplicity and illustrative purposes, the present disclosure is described by referring mainly to examples thereof. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure.

Throughout the present disclosure, the terms "a" and "an" are intended to denote at least one of a particular element. As used herein, the term "includes" means includes but not limited to, the term "including" means including but not limited to. The term "based on" means based at least in part on.

A system and method for toner coverage determination are described herein and provide for strategic sampling of a subset of pixels in an image to locate the pixel(s) with maximum pixel intensity value(s). The maximum pixel intensity value may represent a maximum toner coverage value that is used to generate a particular pixel on a page. The maximum toner coverage value may be represented as a percentage value. The maximum toner coverage value may be used to determine how the temperature of a fuser will be controlled during printing. For example, pages that are determined to have high coverage pixels (e.g., photos), may need to be fused at higher temperatures while pages determined to have lower coverage pixels (e.g., text documents) may be fused at lower temperatures. The system and method may be used to adjust runtime performance versus accuracy of image reproduction, for example, based on the number of pixels sampled in an image. Based, for example, on toner coverage value determination, fuser temperature may also be lowered without impacting printer throughput or print quality, thus allowing for reduced VOC emissions, reduced power consumption and reduced wear on the fuser. The system and method may also be applied to any type of ink products that include an attached ink drying system.

An example of application of the toner coverage determination system and method is described herein for a red, green, and blue (RGB) input color space mapped to a cyan-magenta-yellow-black (CMYK) output color space. However, the system and method may be applied to any type of input and output color spaces, such as, LAB, CIE XYZ, RGB, CMYK, etc. Generally, the RGB color model is an additive color model in which red, green, and blue light is added together in various ways to reproduce a broad array of colors. The CMYK color space is a subtractive color model used in color printing and uses the inks cyan, magenta, yellow, and key (black). The LAB color space is a color-opponent space with dimension L for lightness and A and B for the color-opponent dimensions, based on nonlinearly compressed commission on Illumination (CIE) XYZ color space coordinates. For the CIE XYZ color space, Y represents luminance, Z is quasi-equal to blue stimulation, or the S cone response, and X is a linear combination of cone response curves chosen to be orthogonal to luminance and nonnegative.

In order to analyze an input image: the image may be sectioned into a subset of tiles (i.e., sample areas or grid blocks). The size and shape of the tiles may be adjusted to provide for performance versus accuracy tuning. For each tile, a certain number of points corresponding to pixels to be sampled may be selected on an inscribed rotated grid. Other points may be analyzed, but not rotated in the sample area. As described in further detail below, the rotated grid prevents horizontal and vertical aliasing effects in down sampling analysis. The pixels corresponding to the selected points may be used to determine the maximum toner coverage value.

An example including a square grid block with four points for sampling the corresponding pixels is described. However, any number of points may be used for sampling. For each point used for sampling, for the foregoing RGB example, a color space conversion (CSC) may be performed between the input RGB color space and the output CMYK color space. In the example, the rendered data may be represented in a RGB 4 bpp (bits per pixel) per plane color space, and the toner may be placed in a CMYK 4 bpp color space. In order to perform the CSC, any of the bits of each of the RGB color planes may be used as an index in an array or a look-up table. In an example discussed herein, the two most significant bits of each of the RGB color planes are used as an index. The output of the array or look-up table may represent a maximum toner coverage value for a given pixel. By comparing the maximum toner coverage values for all sampled pixels, an overall maximum toner coverage value for a page to be printed may be determined. The maximum toner coverage value for the page may be output to firmware for fuser temperature determination and control, and print speed determination and control.

Based on the maximum toner coverage value determination, generally, on pages with lower maximum toner coverage value(s), the fuser temperature may be reduced, which allows for lower VOC emissions and lower power consumption for the fuser. The foregoing aspects also provide for a constant print speed independent of the fuser temperature.

In an example, a toner coverage determination system is described herein and generally includes a memory storing a module comprising machine readable instructions to receive an input image, and generate a grid including a plurality of points corresponding to pixels to be sampled on the input image. The machine readable instructions further sample the pixels corresponding to the plurality of points, evaluate pixel intensity values for the sampled pixels, and determine a toner coverage value based on the evaluated pixel intensity values. A processor may implement the module.

In an example, a method for fuser temperature control is described herein and generally includes receiving an input image, and generating a grid including a plurality of points corresponding to pixels to be sampled on the input image. The method may further include sampling the pixels corresponding to the plurality of points, evaluating pixel intensity values for the sampled pixels, determining, by a processor, a toner coverage value based on the evaluated pixel intensity values, and using the determined toner coverage value to set a fuser temperature.

In an example, a non-transitory computer readable medium having stored thereon machine readable instructions for toner coverage determination is also described. The machine readable instructions that when executed may cause a computer system to receive an input image, and generate a grid including a plurality of points corresponding to pixels to be sampled on the input image. The machine readable instructions may further cause the computer system to sample the pixels corresponding to the plurality of points, evaluate pixel intensity values for the sampled pixels, and determine, by a processor, a toner coverage value based on the evaluated pixel intensity values.

In an example, a circuit for toner coverage determination includes hardware to receive an input image, and generate a rotated grid including a plurality of points corresponding to pixels to be sampled on the input image such that points between adjacent grid blocks are disposed at a maximum distance apart. The circuit further includes hardware to sample the pixels corresponding to the plurality of points, evaluate pixel intensity values for the sampled pixels, and determine a toner coverage value based on the evaluated pixel intensity values. The circuit may include an application-specific integrated circuit (ASIC), which may be customized for toner coverage determination.

FIG. 1 illustrates an architecture of a toner coverage determination system 100, according to an example. Referring to FIG. 1, the system 100 is depicted as including a grid generation module 101 that receives an input image 102 and generates an inscribed rotated grid for sampling the input image 102. A sampling module 103 may sample pixels corresponding to points on the rotated grid. A maximum toner coverage value determination module 104 may convert the input color space of the image 102 (e.g., image details or full image) to the output color space used by a printer (not shown). The module 104 may use the input color space as an index in an array or a look-up table to determine a maximum toner coverage value. The maximum toner coverage value may be output to a fuser temperature determination and control module 105 and a print speed determination and control module 106. The modules 105, 106 may respectively use the maximum toner coverage value to determine and control fuser temperature and print speed. The modules 105, 106 may be part of the system 100, or provided as separate firmware.

The modules 101 and 103-106, and other components of the system 100 may comprise machine readable instructions stored on a computer readable medium. In addition, or alternatively, the modules 101 and 103-106, and other components of the system 100 may comprise hardware or a combination of machine readable instructions and hardware.

Figure 2:
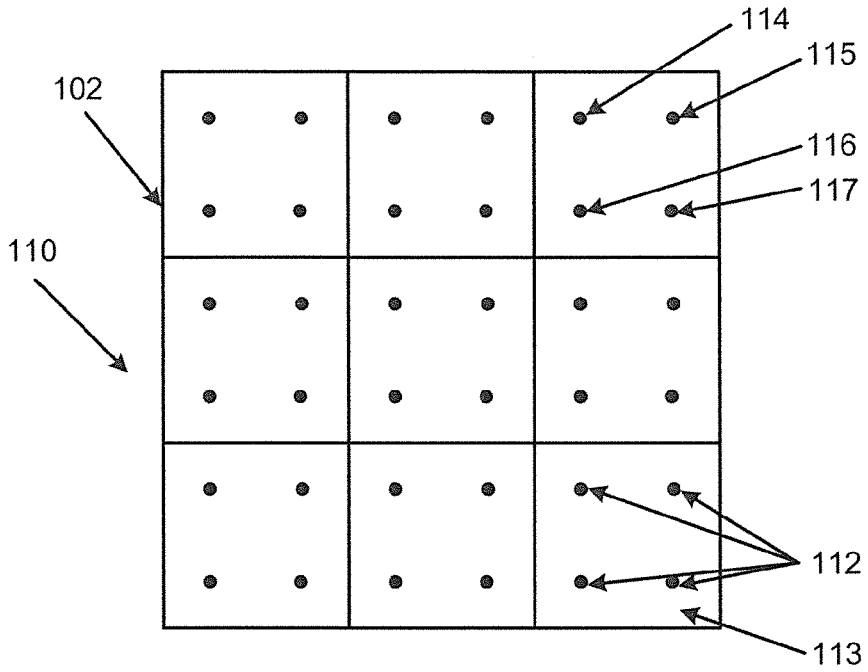
FIG. 2 illustrates a layout of a non-rotated sampling grid, according to an example of the present disclosure.
Figure 3:
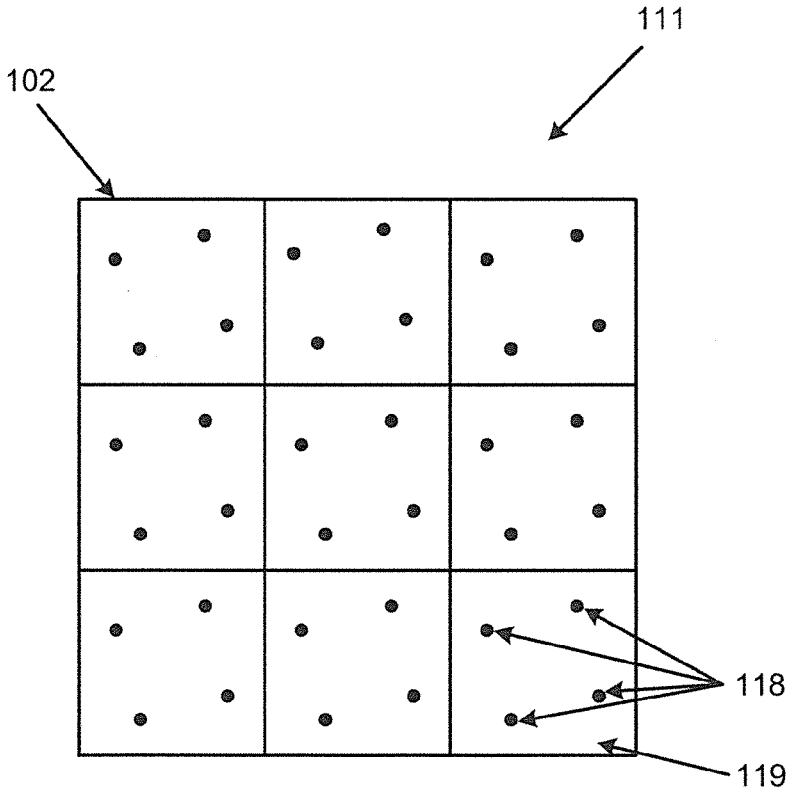
FIG. 3 illustrates a layout of a rotated sampling grid, according to an example of the present disclosure.
Figure 4:
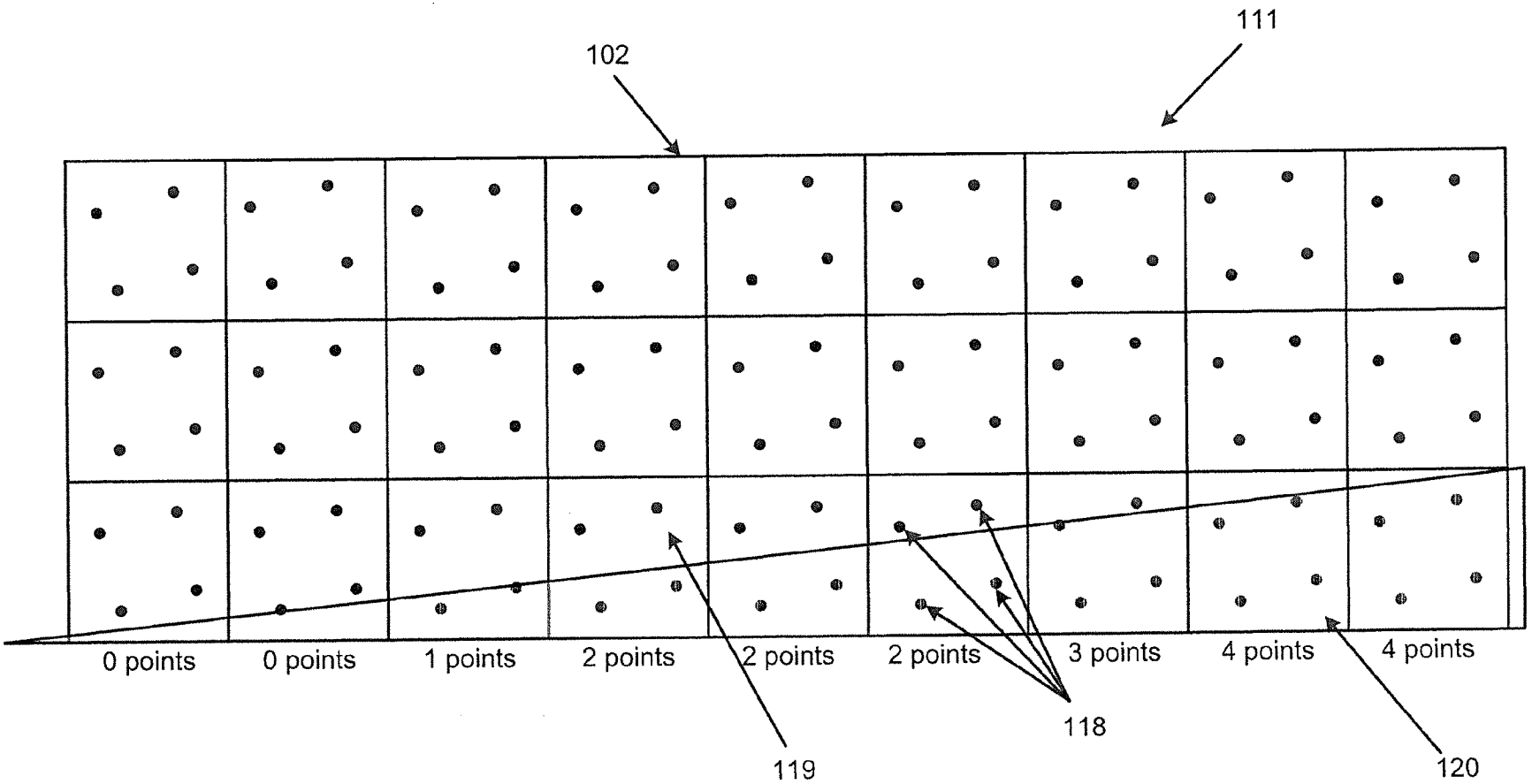
FIG. 4 illustrates sampling using the rotated sampling grid of FIG. 3, according to an example of the present disclosure.

Referring to FIGS. 2-4, the grid generation module 101 may generate a rotated sampling grid for the image 102. The rotated sampling grid may be generated based on image parameters, such as, the location and orientation of the image or a particular area on the image that is to be sampled. Referring to FIGS. 2 and 3, non-rotated and rotated sampling grids 110, 111 are illustrated. The non-rotated sampling grid 110 includes horizontally and vertically disposed points 112 corresponding to pixels for each grid block 113. The horizontally and vertically disposed points 112 may lead to aliasing in the horizontal and vertical directions and over-sampling due to shared horizontal and vertical coordinates of the points 112. For example, for each grid block 113, a row including points 114, 115 and a row including points 116, 117 would be oversampled in the horizontal direction, and similarly, a column including points 114, 116 and a column including points 115, 117 would be oversampled in the vertical direction. Compared to the non-rotated sampling grid 110, the rotated sampling grid 111 allows for efficient sampling where the pixels corresponding to points 118 for each grid block 119 may be averaged to form a new pixel, if the image is to be down-sampled. Referring to FIGS. 2-4, it can be seen that the points 118 of the rotated sampling grid 111 do not share horizontal and vertical coordinates as do points 112 of the non-rotated sampling grid 110. A pixel corresponding to a point in the rotated sampling grid 111 is sampled once. For example, it can be seen in FIG. 4 that pixels corresponding to the points 118 of the rotated sampling grid 111 are sampled once for image 120. Thus, compared to a non-rotated grid where sharing horizontal and vertical coordinates may lead to details in an image potentially not being sampled, or being over-sampled, the rotated sampling grid 111 of FIGS. 3 and 4 minimizes such aliasing related issues.

Figure 5:
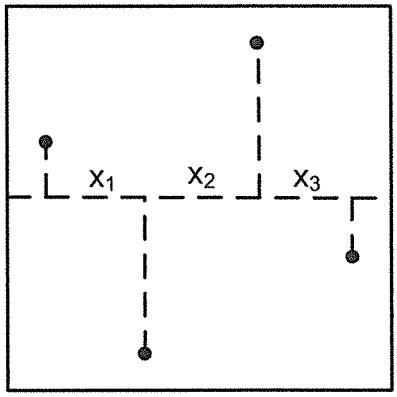
FIG. 5 illustrates a layout for calculating a grid rotation angle for the rotated sampling grid of FIG. 3, according to an example of the present disclosure.
Figure 6:
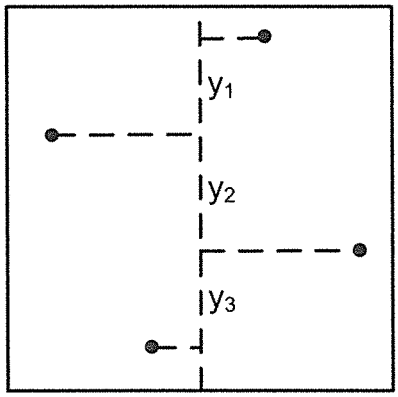
FIG. 6 illustrates a layout for calculating the grid rotation angle for the rotated sampling grid of FIG. 3, according to an example of the present disclosure.
Figure 7:
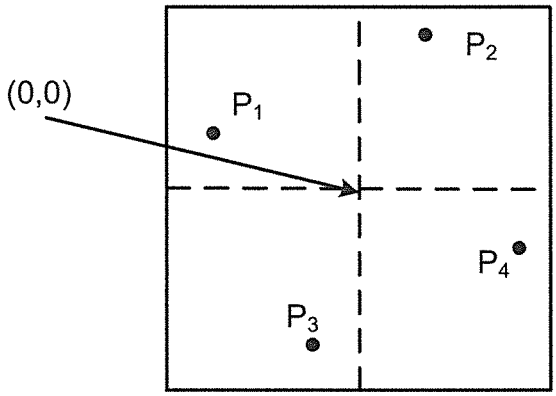
FIG. 7 illustrates a layout for calculating the grid rotation angle for the rotated sampling grid of FIG. 3, according to an example of the present disclosure.

Referring to FIGS. 1, 3 and 4, in order to generate the rotated sampling grid 111 to optimize spacing for sampled pixels such that all sampled grid blocks 119 have pixels (i.e., none of the sampled grid blocks 119 have missing pixels), for a four point grid block, the grid generation module 101 rotates the grid at a rotation angle of approximately 26.6°. For a grid block including four points, the approximately 26.6° rotation angle provides a maximum distance between all of the points in the rotated sampling grid 111. For example, referring to FIGS. 5 and 6, in order to determine the optimal rotation angle, the rotated sampling grid 111 may be rotated such that the spacing $\Delta x$ between points $x_1$, $x_2$ and $x_3$ is identical (i.e., $x_1=x_2=x_3=\Delta x$), and the spacing $\Delta y$ between points $y_1$, $y_2$ and $y_3$ is identical (i.e., $y_1=y_2=y_3=\Delta y$). Referring to FIGS. 5-7, the optimal rotation angle of approximately 26.6° for the rotated sampling grid 111 including the four points 118 may be determined by setting points $P_1$, $P_2$, $P_3$, and $P_4$, in terms of a generic scalar s, such that $P_1=(-3s, s)$, $P_2=(s, 3s)$, $P_3=(-s, -3s)$ and $P_4=(3s, -s)$. The foregoing criteria regarding the spacing $\Delta x$ and $\Delta y$ may be satisfied by setting $|\Delta x_{(P_1,P_3)}|=2s$, $|\Delta x_{(P_3,P_2)}|=2s$, $|\Delta x_{(P_2,P_4)}|=2s$, $|\Delta y_{(P_2,P_1)}|=2s$, $|\Delta y_{(P_1,P_4)}|=2s$ and $|\Delta y_{(P_4,P_3)}|=2s$. The rotation angle (i.e., θ) for the rotated sampling grid 111 may be determined by using a non-rotated grid of same radius as shown in FIG. 7 (i.e., radius$=\sqrt{s^2+(3s)^2}=s\cdot\sqrt{10}$). Using a $$x\text{-coordinate} = \frac{s\cdot\sqrt{10}}{\sqrt{2}},$$

and a $$y\text{-coordinate} = \frac{s\cdot\sqrt{10}}{\sqrt{2}}$$

for the radius, the optimal rotation angle θ of approximately 26.6° may be determined using an Affine Transform as follows:

$$\begin{bmatrix} \cos\theta & -\sin\theta \\ \sin\theta & \cos\theta \end{bmatrix} \cdot \begin{bmatrix} \frac{s\cdot\sqrt{10}}{\sqrt{2}} \\ \frac{s\cdot\sqrt{10}}{\sqrt{2}} \end{bmatrix} = \begin{bmatrix} s \\ 3s \end{bmatrix}$$

Figure 8:
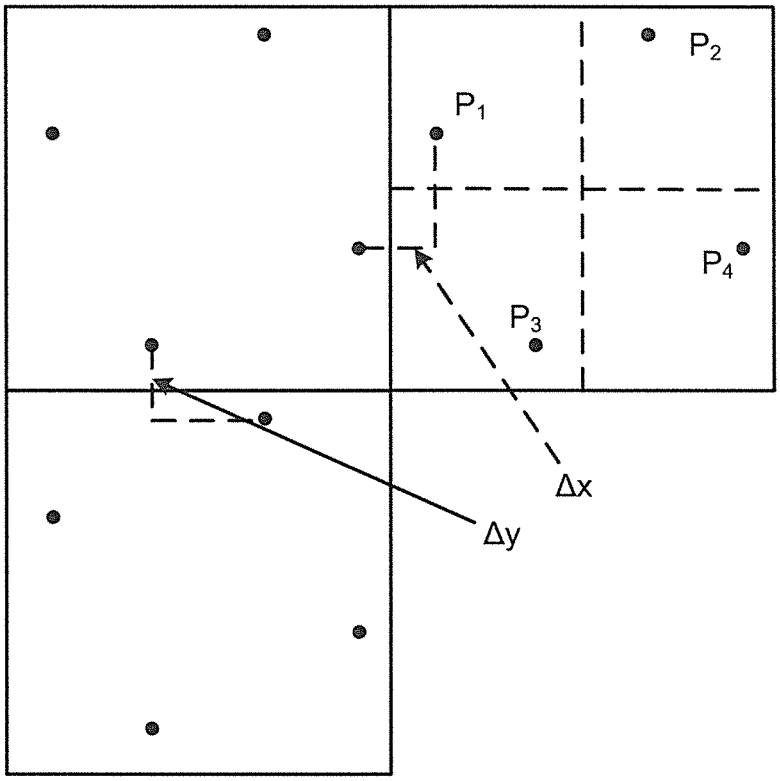
FIG. 8 illustrates a layout for calculating the grid rotation angle for the rotated sampling grid of FIG. 3, according to an example of the present disclosure.

Referring to FIGS. 7 and 8, for points $P_1$, $P_2$, $P_3$, and $P_4$, for the rotation angle θ of approximately 26.6° and with the overall grid size being 8s, the spacing between points in adjoining grid blocks is the same such that $\Delta x=\Delta y=2s$. The grid generation module 101 may similarly determine the optimal rotation angle θ for a grid including more than four points, or a different spacing for adjacent pixels. The rotation angle θ may also be adjusted (i.e., increased or decreased) to increase or decrease sampling in a given direction.

Figure 9:
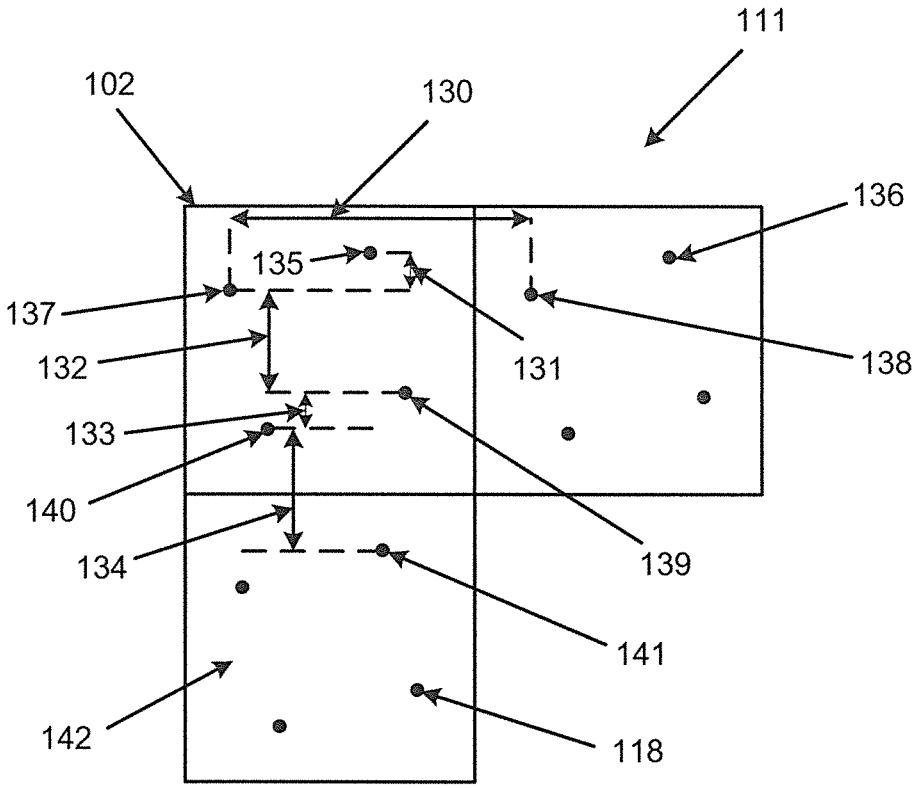
FIG. 9 illustrates a layout for calculating sampling points for the rotated sampling grid of FIG. 3, according to an example of the present disclosure.

Referring to FIGS. 1 and 9, in order to facilitate efficient sampling by the sampling module 103, the grid generation module 101 may generate coordinates for the points on the rotated sampling grid 111. The rotated sampling grid 111 may generally include a grid size 130, and vertical distances 131-134 between the grid points. The points 118 of the rotated sampling grid 111 may be sampled such that point 135 (i.e., the highest vertical point on the image 102) is sampled first. Based on the grid size 130, the sampling module 103 may next shift horizontally by the grid size 130 to sample point 136, and continue to shift horizontally by the grid size 130 until all points in the image 102 matching the vertical coordinate of the point 135 are sampled. The sampling module 103 may next shift vertically by the distance 131 to sample point 137, and thereafter shift horizontally by the grid size 130 to sample point 138. The sampling module 103 may continue to shift horizontally by the grid size 130 until all points in the image 102 matching the vertical coordinate of the point 137 are sampled. In this manner, the sampling module 103 may next shift vertically by the distance 132 to sample point 139, and then horizontally by the grid size 130 until all points in the image 102 matching the vertical coordinate of the point 139 are sampled. Thereafter, the sampling module 103 may next shift vertically by the distance 133 to sample point 140, and then horizontally by the grid size 130 until all points in the image 102 matching the vertical coordinate of the point 140 are sampled. Thereafter, the sampling module 103 may next shift vertically by the distance 134 to sample point 141 in grid block 142 and then horizontally by the grid size 130 until all points in the image 102 matching the vertical coordinate of the point 141 are sampled. The remaining vertical points in grid block 142 and any further horizontal and vertical grid blocks may be sampled in a similar manner as discussed above until the entire image 102 is sampled.

With the image 102 sampled, the maximum toner coverage value determination module 104 may convert the input color space of the image 102 to the output color space used by a printer (not shown). Alternatively, the CSC may be performed simultaneously during sampling of the pixels of the image 102. The CSC may also be bypassed if the input and output color spaces are identical, in which case the maximum toner coverage value may be determined based on the input color space.

If a CSC is performed, for example, for a RGB input color space of the image 102 to a CMYK output color space of a printer, for each pixel sampled by the sampling module 103, the maximum toner coverage value determination module 104 may first determine the type of pixel (i.e., raster or text pixel in an image). This is used to determine how black is converted to either process black (CMY toners applied in even amounts) or K black (using just the K toner). For the RGB to CMYK CSC performed, intensity of the four possible color planes of a pixel may be analyzed, for example, based upon a ratio of the current value of the intensity of a pixel in a plane versus the maximum value for the intensity of a pixel in a plane and expressed as a percentage. This pixel intensity corresponds to the toner coverage for the pixel. For example, RGB values of 51.102.255, 51.255.204, and 255.204.51 may respectively represent toner coverage values of 140%, 100% and 100%. For this example, the toner coverage values of 140%, 100% and 100% may be determined by performing a CSC from ROB to CMYK values (note: by using process black, K=0). The ROB to CMYK conversion is as follows: 51.102.255→204.153.0.0, 51.255.204→204.0.51.0, and 255.204.51→0.51.204.0. With the CSC complete, the toner coverage values may be determined by finding the coverage percentage (i.e., value/255) for each plane and adding the coverage percentage values (i.e., 204.153.0.0→80%, 60%, 0%, 0%, 204.0.51.0→80%, 0%, 20%, 0%, 0.51.204.0→0%, 20%, 80%, 0%). Therefore, the toner coverage values of 140%, 100% and 100% may be determined by adding the foregoing coverage percentage values.

With CSC performed if needed, the module 104 may determine if the toner coverage for a particular pixel is greater than a threshold. The threshold may be predetermined based on a maximum toner coverage value (e.g., for a particular type of image), or otherwise set based on the first toner coverage value for a pixel sampled (e.g., the pixel corresponding to the first point 135 of FIG. 9) in the image 102. Thereafter, for each pixel sampled, if the toner coverage value is greater than the threshold, the threshold may be increased to the toner coverage value specified by the latter pixel sampled. With all pixels in the image 102 sampled, the final threshold value thus corresponds to a maximum toner coverage value specified by a sampled pixel. Alternatively, the threshold may remain fixed during the analysis, and a sampled maximum value may be determined. In this case, the threshold may correspond to a minimum value used for fuser temperature determination. Initially, the sampled maximum value may correspond to the first pixel sampled. For each subsequent pixel sampled, if the toner coverage value is greater than the sampled maximum value, the sampled maximum value may be increased to the toner coverage value specified by the latter pixel sampled. With all pixels in the image 102 sampled, the final sampled maximum value thus corresponds to a maximum toner coverage value specified by a sampled pixel. The maximum toner coverage value may be used by the fuser temperature determination and control module 105 to control the fixing temperature of the fuser to allow for the minimum temperature to be selected to successfully fix the toner to the page with no print quality defects.

Figure 10:
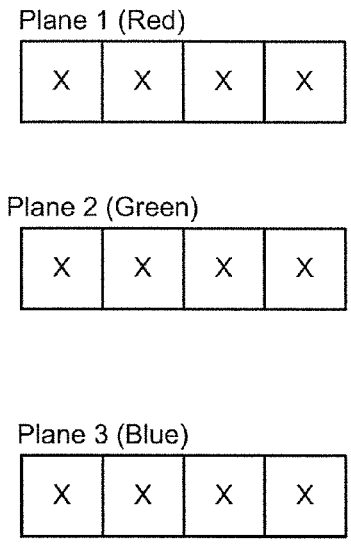
FIG. 10 illustrates a layout for color space conversion (CSC), according to an example of the present disclosure.
Figure 11:
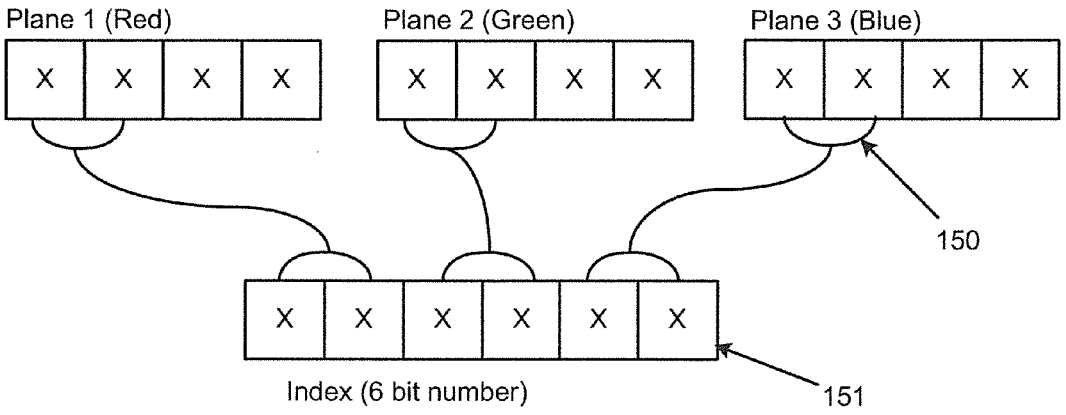
FIG. 11 illustrates a layout for CSC, according to an example of the present disclosure.

An example of CSC is described with reference to FIGS. 1-11. For example, for a RGB to CMYK CSC, when examining a pixel, there are three RGB color plane intensities associated with a pixel. These intensities may be represented by a variable number of bits (e.g., four bits). For each pixel, as shown in FIGS. 10 and 11, the upper two most significant bits 150 of the four bit representation may be concatenated to form a six bit value 151, which is then used to form an index to a lookup table. The number of bits used to form the index may be increased or decreased respectively to increase or decrease the accuracy of the CSC. The six bit value forming the index to the lookup table may be combined with one or more two bit values describing the raster type of the pixel (e.g., process black versus true black). For the six bit example, the lookup table may be structured to include rows indicating the raster type of the pixel, and columns indexed by the six bit value 151. For the six bit example, the lookup table may include $2^6$ columns. The data in the lookup table may represent a maximum pixel intensity value for the sampled pixels, and may be converted to a maximum toner coverage value for the six bit index and the raster type of the pixel in the new color space. A different lookup table may be provided for each type of CSC, which provides a dynamic approach to CSC depending on the type of input and output color spaces.

Figure 12:
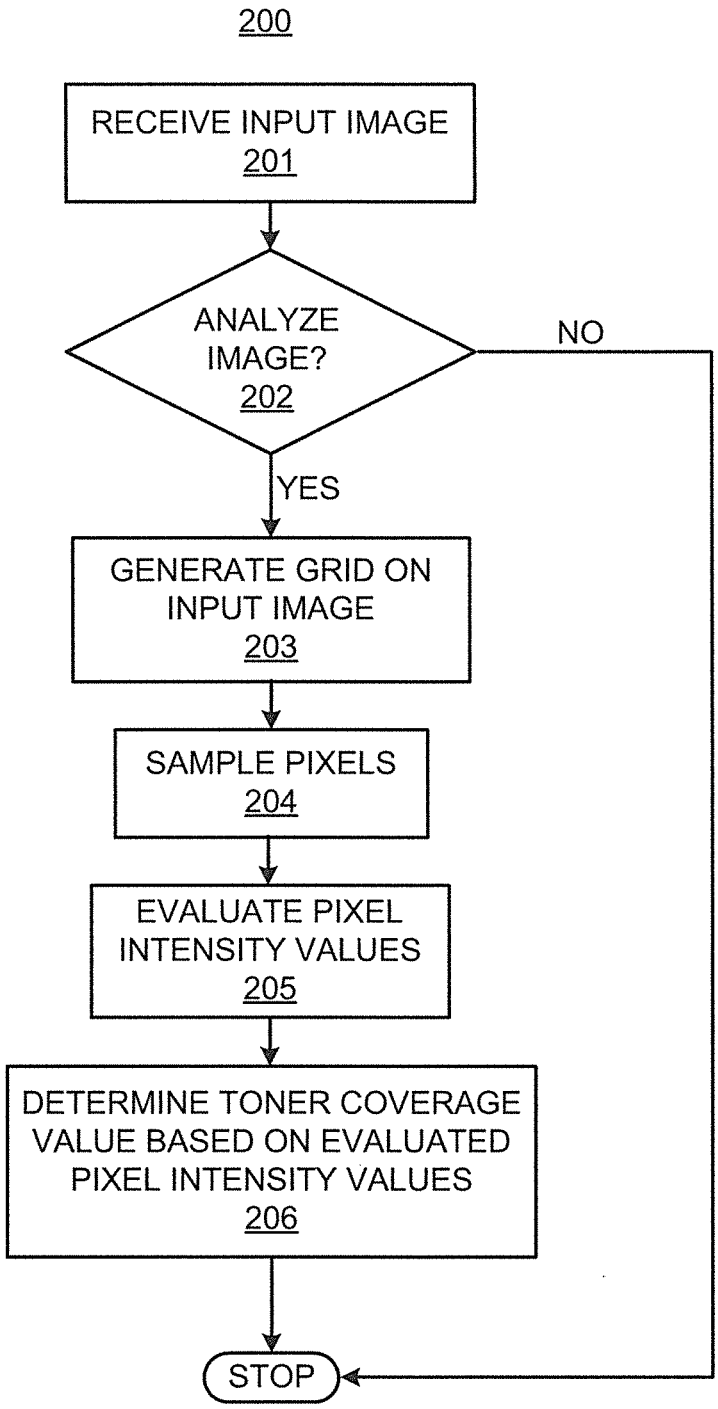
FIG. 12 illustrates a method for toner coverage determination, according to an example of the present disclosure.

FIG. 12 illustrates a flowchart of method 200 for toner coverage determination, corresponding to the example of the toner coverage determination system 100 whose construction is described in detail above. The method 200 may be implemented on the toner coverage determination system 100 with reference to FIGS. 1-11 by way of example and not limitation. The method 200 may be practiced in other systems.

Referring to FIG. 12, for the method 200, at block 201, the grid generation module 101 receives an input image. For example, referring to FIG. 1, the grid generation module 101 receives the input image 102.

At block 202, the grid generation module 101 determines if the image 102 should be analyzed to determine toner coverage. For example, if the image is a single planar text or monochrome image printed in black, no toner coverage determination is performed and the fuser temperature may be set to a predetermined value based on the image type.

At block 203, if it is determined that toner coverage determination is to be performed on the image type, a grid including a plurality of points corresponding to pixels to be sampled on the input image is generated. For example, referring to FIGS. 3-9, the grid generation module 101 may generate the rotated sampling grid 111 for the image 102. As shown in FIG. 3, in the example illustrated, the rotated sampling grid 111 may be a 64×64 sampling grid and include four points 118 per grid block 119. The grid generation module 101 may rotate the grid such that points between adjacent grid blocks are disposed at a maximum distance apart. Referring to FIGS. 1 and 9, the grid generation module 101 may also generate coordinates for the points on the rotated sampling grid 111.

At block 204, the pixels corresponding to the plurality of points are sampled. For example, referring to FIGS. 1 and 9, generally, the sampling module 103 may determine rows of the pixels on the image. The module 103 may sample a pixel (e.g., the pixel corresponding to the point 135) disposed in a row corresponding to a highest vertical location on the image relative to a vertical axis, and sample any further pixels disposed in the row based on a grid size (e.g., the grid size 130). The module 103 may further sequentially sample remaining rows of the pixels by sampling a pixel (e.g., the pixel corresponding to the point 137) disposed in a row corresponding to a second highest vertical location on the image, and sample any further pixels disposed in the row corresponding to the second highest vertical location on the image based on the grid size, until all the rows of the pixels are sampled.

At block 205, pixel intensity values are evaluated for the sampled pixels. For example, referring to FIG. 1, with the image 102 sampled, if needed, the maximum toner coverage value determination module 104 may convert the input color space of the image 102 to the output color space used by a printer (not shown). With or without a CSC, the maximum toner coverage value determination module 104 may evaluate pixel intensity values for the sampled pixels. The evaluation may include determining a pixel intensity value for a sampled pixel, comparing the pixel intensity value to a threshold, setting a new threshold to correspond to the pixel intensity value if the pixel intensity value is greater than the threshold, and determining a maximum pixel intensity value based on the value of the new threshold after evaluation of the pixels sampled in the image.

At block 206, a toner coverage value is determined based on the evaluated pixel intensity values. For example, referring to FIG. 1, with all pixels in the image 102 sampled, the final threshold value (or sampled maximum value as discussed above) thus corresponds to a maximum toner coverage value specified by a sampled pixel. This maximum toner coverage value may be used by the fuser temperature determination and control module 105 to control the fixing temperature of the fuser to allow for the minimum temperature to be selected to successfully fix the toner to the page with no print quality defects.

Figure 13:
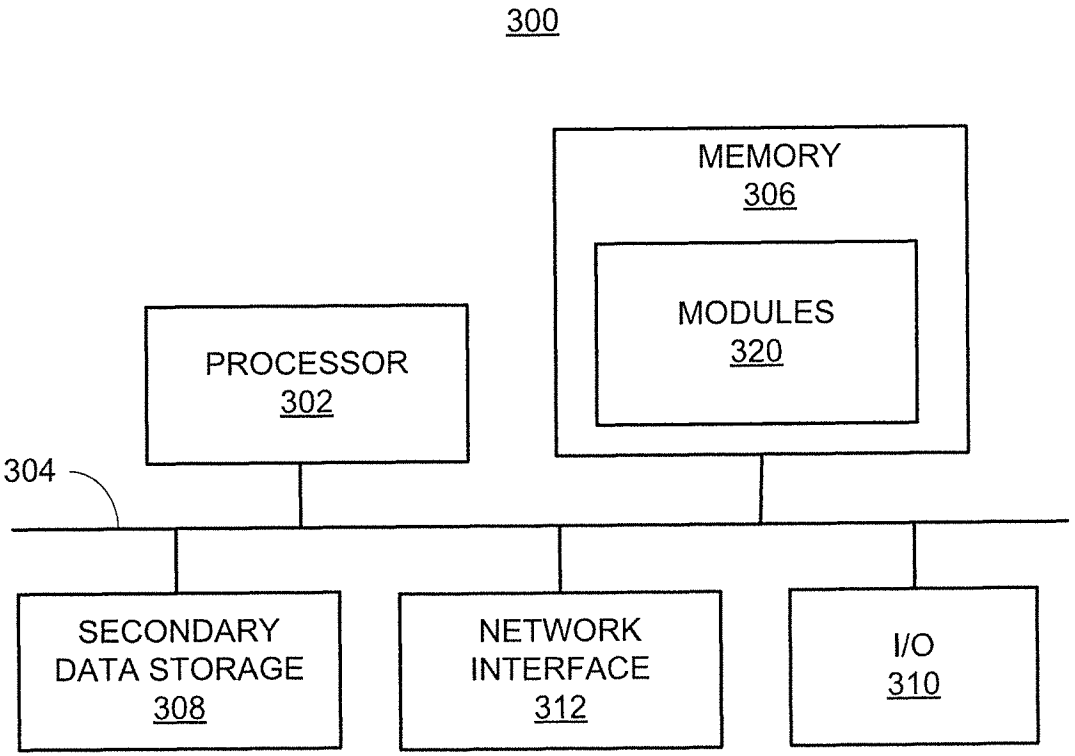
FIG. 13 illustrates a computer system, according to an example of the present disclosure.

FIG. 13 shows a computer system that may be used with the examples described herein. The computer system represents a generic platform that includes components that may be in a server or another computer system. The computer system may be used as a platform for the system 100. The computer system may execute, by a processor or other hardware processing circuit, the methods, functions and other processes described herein. These methods, functions and other processes may be embodied as machine readable instructions stored on a computer readable medium, which may be non-transitory, such as hardware storage devices (e.g., RAM (random access memory), ROM (read only memory), EPROM (erasable, programmable ROM), EEPROM (electrically erasable, programmable ROM), hard drives, and flash memory).

The computer system includes a processor 302 that may implement or execute machine readable instructions performing some or all of the methods, functions and other processes described herein. Commands and data from the processor 302 are communicated over a communication bus 304. The computer system also includes a main memory 306, such as a random access memory (RAM), where the machine readable instructions and data for the processor 302 may reside during runtime, and a secondary data storage 308, which may be non-volatile and stores machine readable instructions and data. The memory and data storage are examples of computer readable mediums. The memory 306 may include modules 320 including machine readable instructions residing in the memory 306 during runtime and executed by the processor 302. The modules 320 may include the modules 101 and 103-106 of the system shown in FIG. 1.

The computer system may include an I/O device 310, such as a keyboard, a mouse, a display, etc. The computer system may include a network interface 312 for connecting to a network. Other known electronic components may be added or substituted in the computer system.

What has been described and illustrated herein is an example along with some of its variations. The terms, descriptions and figures used herein are set forth by way of illustration only and are not meant as limitations. Many variations are possible within the spirit and scope of the subject matter, which is intended to be defined by the following claims—and their equivalents—in which all terms are meant in their broadest reasonable sense unless otherwise indicated.

What is claimed is:

1. A toner coverage determination system comprising:

a memory storing a module comprising machine readable instructions to:

receive an input image;

generate a grid including a plurality of points corresponding to pixels to be sampled on the input image;

sample the pixels corresponding to the plurality of points;

evaluate pixel intensity values for the sampled pixels; and determine a toner coverage value based on the evaluated pixel intensity values; and a processor to implement the module.

2. The toner coverage determination system of claim 1, wherein the grid includes grid blocks, the module further comprising machine readable instructions to:

rotate the grid such that points between adjacent grid blocks are disposed at a maximum distance apart.

3. The toner coverage determination system of claim 1, wherein the grid includes grid blocks including four points, the module further comprising machine readable instructions to:

rotate the grid at approximately 26.6° relative to a horizontal axis such that points between adjacent grid blocks are disposed at a maximum distance apart.

4. The toner coverage determination system of claim 1, wherein the machine readable instructions to sample the pixels corresponding to the plurality of points further comprise:

determining rows of the pixels on the image;

sampling a pixel disposed in a row corresponding to a highest vertical location on the image relative to a vertical axis;

sampling any further pixels disposed in the row based on a grid size; and sequentially sampling remaining rows of the pixels by sampling a pixel disposed in a row corresponding to a second highest vertical location on the image, sampling any further pixels disposed in the row corresponding to the second highest vertical location on the image based on the grid size, until all the rows of the pixels are sampled.

5. The toner coverage determination system of claim 1, the module further comprising machine readable instructions to:

determine a maximum pixel intensity value based on the evaluated pixel intensity values.

6. The toner coverage determination system of claim 1, wherein the machine readable instructions to evaluate pixel intensity values for the sampled pixels further comprise:

determining a pixel intensity value for a sampled pixel;

comparing the pixel intensity value to a threshold;

setting a new threshold to correspond to the pixel intensity value if the pixel intensity value is greater than the threshold; and determining a maximum pixel intensity value based on the value of the new threshold after evaluation of the pixels sampled in the image.

7. The toner coverage determination system of claim 1, wherein the machine readable instructions to evaluate pixel intensity values for the sampled pixels further comprise:

determining a pixel intensity value for a sampled pixel;

setting a sampled maximum value based on the pixel intensity value;

determining the pixel intensity value for an additional pixel;

comparing the pixel intensity value for the additional pixel to the sampled maximum value; and if the pixel intensity value for the additional pixel is greater than the sampled maximum value, setting the sampled maximum value to correspond to the pixel intensity value.

8. The toner coverage determination system of claim 1, wherein the machine readable instructions to determine a toner coverage value based on the evaluated pixel intensity values further comprise:

using a predetermined number of bits of the evaluated pixel intensity values as an index to a table to determine the corresponding toner coverage value.

9. The toner coverage determination system of claim 1, the module comprising machine readable instructions to:

translate pixel intensity values for an input color space corresponding to the image to an output color space for printing the image.

10. A method for fuser temperature control, the method comprising:

receiving an input image;

generating a grid including a plurality of points corresponding to pixels to be sampled on the input image;

sampling the pixels corresponding to the plurality of points;

evaluating pixel intensity values for the sampled pixels; and determining, by a processor, a toner coverage value based on the evaluated pixel intensity values; and using the determined toner coverage value to set a fuser temperature.

11. The method of claim 10, wherein the grid includes grid blocks, the method further comprising:

rotating the grid such that points between adjacent grid blocks are disposed at a maximum distance apart.

12. The method of claim 10, further comprising:

determining rows of the pixels on the image;

sampling a pixel disposed in a row corresponding to a highest vertical location on the image relative to a vertical axis;

sampling any further pixels disposed in the row based on a grid size; and sequentially sampling remaining rows of the pixels by sampling a pixel disposed in a row corresponding to a second highest vertical location on the image, sampling any further pixels disposed in the row corresponding to the second highest vertical location on the image based on the grid size, until all the rows of the pixels are sampled.

13. The method of claim 10, further comprising:

determining a pixel intensity value for a sampled pixel;

comparing the pixel intensity value to a threshold;

setting a new threshold to correspond to the pixel intensity value if the pixel intensity value is greater than the threshold; and determining a maximum pixel intensity value based on the value of the new threshold after evaluation of the pixels sampled in the image.

14. The method of claim 10, wherein print speed remains constant independent of the fuser temperature.

15. A circuit for toner coverage determination, comprising:

hardware to:

receive an input image;

generate a rotated grid including a plurality of points corresponding to pixels to be sampled on the input image such that points between adjacent grid blocks are disposed at a maximum distance apart;

sample the pixels corresponding to the plurality of points;

evaluate pixel intensity values for the sampled pixels; and determine a toner coverage value based on the evaluated pixel intensity values.

16. The circuit of claim 15, further comprising an application-specific integrated circuit (ASIC).

* * * * *